US011603237B2

(12) United States Patent
Migas et al.

(10) Patent No.: US 11,603,237 B2
(45) Date of Patent: Mar. 14, 2023

(54) FLIP-TOP CLOSURE

(71) Applicant: Closure Systems International Inc., Memphis, TN (US)

(72) Inventors: Jeremiah Migas, Crawfordsville, IN (US); Marina Lennartz, Liberty Township, OH (US); Jeremy Morin, Zionsville, IN (US)

(73) Assignee: CLOSURE SYSTEMS INTERNATIONAL INC., Indianapolis, IN (US)

( * ) Notice: Subject to any disclaimer, the term of this patent is extended or adjusted under 35 U.S.C. 154(b) by 230 days.

(21) Appl. No.: 17/061,758

(22) Filed: Oct. 2, 2020

(65) Prior Publication Data

US 2021/0101722 A1 Apr. 8, 2021

Related U.S. Application Data

(60) Provisional application No. 62/911,449, filed on Oct. 7, 2019.

(51) Int. Cl.
*B65D 47/08* (2006.01)
*B65D 55/02* (2006.01)

(52) U.S. Cl.
CPC ..... *B65D 47/0804* (2013.01); *B65D 55/024* (2013.01); *B65D 2401/20* (2020.05)

(58) Field of Classification Search
CPC .. B65D 47/0804; B65D 55/024; B65D 55/16; B65D 41/325; B65D 41/465; B65D 2401/20; B65D 2251/1008
(Continued)

(56) References Cited

U.S. PATENT DOCUMENTS 2,124,873 A 7/1938 Conner
3,272,368 A * 9/1966 Van Baarn ..... B65D 41/485 215/320
(Continued)

FOREIGN PATENT DOCUMENTS

CN 1830730 A 9/2006
DE 297 06 672 U1 6/1997
(Continued)

OTHER PUBLICATIONS

CrystalGeyser1Cap.com, "Crystal Geyser Alpine Spring Water: Introducing 1-Cap Satisfaction," Web page, <URL:https://crystalgeyser1cap.com/> Retrieved from the Internet on Jan. 12, 2021; Published online 2018 (2 pages).
(Continued)

*Primary Examiner* — Chun Hoi Cheung
*Assistant Examiner* — Brijesh V. Patel
(74) *Attorney, Agent, or Firm* — Nixon Peabody LLP

(57) ABSTRACT

A flip-top closure includes first and second polymeric closure portions. The first closure portion includes a top wall portion, a sealing mechanism and an annular skirt portion. The second closure portion includes a tamper-evident band. The closure portions are attached by a line of weakness. The closure portions are further attached via a hinge. The hinge includes a locking tab, a flexible tab and linking segments. The locking tab extends further outwardly from a center of the closure in a closed position than the flexible tab and the linking segments. During the opening of the flip-top closure, the locking tab moves and passes the flexible tab such that the flip-top closure locks in a fully open position.

36 Claims, 7 Drawing Sheets

(58) Field of Classification Search
USPC ..... 215/235, 344, 237, 253, 354, DIG. 1; 222/556, 517, 546; 220/831, 375, 835, 220/780, 838, 840
See application file for complete search history.

(56) References Cited

U.S. PATENT DOCUMENTS 3,815,771 A * 6/1974 Marks ..... B65D 41/0428 215/344
3,844,439 A * 10/1974 Demers ..... B65D 41/0428 215/344
3,901,403 A 8/1975 Menke
3,944,104 A * 3/1976 Watson ..... B65D 41/0421 215/354
4,047,495 A * 9/1977 O'Brian ..... B65D 47/0814 220/281
4,158,902 A * 6/1979 Chernack ..... E05D 1/02 220/838
4,166,552 A 9/1979 Faulstitch
4,276,989 A * 7/1981 Hicks ..... B65D 41/0428 215/DIG. 1
4,305,516 A 12/1981 Peme
4,326,639 A 4/1982 Stahl
4,346,811 A 8/1982 Hilaire
4,394,918 A * 7/1983 Grussen ..... B65D 41/3428 215/253
4,402,418 A 9/1983 Ostrowsky
4,450,100 A 5/1984 Kano
4,458,821 A 7/1984 Ostrowsky
4,470,513 A 9/1984 Ostrowsky
4,478,343 A 10/1984 Ostrowsky
4,485,934 A 12/1984 Maguire
4,534,479 A 8/1985 Conti
4,550,844 A 11/1985 Lininger
4,562,931 A 1/1986 Brach
4,593,830 A 6/1986 Bullock
4,595,110 A 6/1986 Herr
4,613,052 A 9/1986 Gregory
4,643,321 A 2/1987 Gach
4,657,153 A 4/1987 Hayes
4,664,278 A 5/1987 Barriac
4,667,838 A 5/1987 Yeager
4,667,839 A 5/1987 Crisci
4,787,525 A * 11/1988 Joyce ..... B65D 47/0838 215/237
4,801,030 A 1/1989 Barriac
4,807,770 A 2/1989 Barriac
4,856,665 A 8/1989 Dutt
4,938,370 A 7/1990 McBride
4,981,230 A 1/1991 Marshall
5,052,574 A 10/1991 McKinnon
5,076,453 A 12/1991 Odet
5,088,612 A * 2/1992 Storar ..... B65D 51/002 215/237
5,207,783 A 5/1993 Burton
5,271,536 A * 12/1993 Wilson ..... B65D 47/0819 222/498
5,456,375 A 10/1995 May
5,465,876 A 11/1995 Crisci
5,547,092 A 8/1996 Thompson
5,564,582 A 10/1996 Kamath
5,573,128 A 11/1996 Tsujiguchi
5,605,240 A * 2/1997 Guglielmini ..... B65D 41/485 215/256
5,678,714 A 10/1997 Guglielmini
5,711,443 A 1/1998 Bennett
5,715,959 A 2/1998 Pfefferkom
5,720,402 A 2/1998 May
5,725,115 A 3/1998 Bosl
5,749,484 A 5/1998 Trout
5,769,263 A 6/1998 Willingham
5,803,286 A * 9/1998 Pfefferkorn ..... B65D 51/1661 215/354
5,806,707 A 9/1998 Boehm
5,813,563 A 9/1998 Boehm
5,862,953 A 1/1999 Breuer
5,891,380 A 4/1999 Lame
5,913,436 A 6/1999 Breuer
5,915,579 A 6/1999 Przytulla
6,029,834 A 2/2000 Sanner
6,039,196 A 3/2000 Ekkert
6,050,436 A 4/2000 Bennett
6,213,321 B1 4/2001 Zumbuhl
6,253,939 B1 7/2001 Wan
6,325,226 B1 12/2001 Krautkramer
6,332,550 B1 12/2001 Bennett
6,481,588 B1 * 11/2002 Wagner ..... B65D 55/16 220/831
6,557,714 B2 5/2003 Babcock
6,758,359 B2 7/2004 Yurkewicz
6,769,575 B1 8/2004 Long, Jr.
6,779,672 B2 * 8/2004 Kano ..... B65D 41/0421 215/354
7,014,055 B2 3/2006 Kano
7,051,888 B2 * 5/2006 Antier ..... B65D 41/485 220/831
7,243,807 B2 7/2007 Lin
7,264,131 B2 9/2007 Tsutsumi
7,299,937 B2 * 11/2007 Antier ..... B65D 41/485 215/253
D578,889 S 10/2008 Sadiq
7,445,130 B2 11/2008 Bosl
7,451,898 B2 11/2008 Seidita
7,503,468 B2 3/2009 Druitt
7,537,159 B2 5/2009 Brozell
7,575,121 B2 8/2009 Ooka
7,581,652 B2 9/2009 Flak
7,607,547 B2 10/2009 Kumata
7,637,384 B2 12/2009 Price
7,645,414 B2 1/2010 Gregory
7,651,004 B2 1/2010 Fuchs
7,703,642 B2 4/2010 Scott
7,802,690 B2 9/2010 Lohrman
7,857,154 B2 12/2010 Pedlar
7,867,425 B2 1/2011 Major
7,905,820 B2 3/2011 Druitt
8,066,133 B2 11/2011 Takamatsu
8,365,934 B2 2/2013 Hamana
8,376,164 B2 * 2/2013 Perrin ..... B65D 41/46 215/DIG. 1
8,393,483 B2 3/2013 Druitt
8,763,830 B2 7/2014 Sadiq
8,794,460 B2 * 8/2014 Druitt ..... B65D 50/061 220/345.2
8,807,360 B2 8/2014 Erspamer
10,364,072 B2 * 7/2019 Tebbe ..... B65D 55/16
2001/0027957 A1 10/2001 Kano
2002/0158037 A1 * 10/2002 Kano ..... B65D 41/0421 215/354
2004/0020943 A1 2/2004 Shinozaki
2004/0060893 A1 4/2004 Kano
2004/0155006 A1 8/2004 Seidita
2004/0178166 A1 9/2004 Antier
2004/0238478 A1 12/2004 Druitt
2005/0077264 A1 4/2005 Fuchs
2005/0173367 A1 8/2005 Nusbaum
2005/0211659 A1 9/2005 Tsutsumi
2005/0252878 A1 11/2005 Babcock
2006/0032831 A1 2/2006 Major
2006/0138071 A1 6/2006 Tsutsumi
2006/0138073 A1 6/2006 Ooka
2006/0151418 A1 7/2006 Scott
2006/0255002 A1 11/2006 Takamatsu
2006/0255003 A1 11/2006 Fuchs
2007/0023380 A1 2/2007 Shingle
2007/0034590 A1 2/2007 Hidding
2007/0090080 A1 4/2007 Lohrman
2007/0181525 A1 8/2007 Gregory
2008/0067142 A1 3/2008 Druitt
2008/0087625 A1 4/2008 Kumata
2008/0093363 A1 4/2008 Pedlar
2008/0314000 A1 12/2008 Druitt
2009/0045158 A1 2/2009 Suriol

(56) References Cited

U.S. PATENT DOCUMENTS

| | | | | |
|---|---|---|---|---|
| 2009/0159555 | A1 | 6/2009 | Druitt | |
| 2009/0223922 | A1* | 9/2009 | King | B65D 41/325 215/346 |
| 2009/0261057 | A1 | 10/2009 | Druitt | |
| 2010/0038337 | A1 | 2/2010 | Garboni | |
| 2010/0276387 | A1 | 11/2010 | Hamana | |
| 2017/0043921 | A1 | 2/2017 | Elliott | |
| 2018/0086510 | A1* | 3/2018 | Berroa Garcia | B65D 47/08 |
| 2020/0180819 | A1 | 6/2020 | Garcia | |

FOREIGN PATENT DOCUMENTS

| | | | | |
|---|---|---|---|---|
| DE | 197 08 909 | A1 | 9/1998 | |
| EP | 2 308 772 | A1 | 4/2011 | |
| EP | 3 081 505 | A1 | 10/2016 | |
| FR | 2278643 | A1 | 11/1999 | |
| JP | 19760177786 | U | 8/1978 | |
| KR | 100 942 642 | B1 | 2/2012 | |
| TW | 201 144 172 | A | 12/2011 | |
| WO | WO 2009/154666 | A2 | 12/2009 | |
| WO | WO 2013/132384 | A1 | 9/2013 | |
| WO | WO 2015/123666 | A1 | 8/2015 | |
| WO | WO-2019113681 | A1 * | 6/2019 | B65D 41/02 |
| WO | WO 2019/175740 | A2 | 9/2019 | |
| WO | WO-2019192714 | A1 * | 10/2019 | B65D 47/0828 |

OTHER PUBLICATIONS

International Search Report and Written Opinion in International Application No. PCT/US2020/053502, dated Feb. 12, 2021 (16 pages).

* cited by examiner

FLIP-TOP CLOSURE

CROSS-REFERENCE TO RELATED APPLICATION

This application claims priority to U.S. Provisional Patent Application No. 62/911,449, filed on Oct. 7, 2019, which is hereby incorporated by reference herein in its entirety.

FIELD OF THE INVENTION

The present invention relates generally to a polymeric closure for a package. More specifically, the present invention relates to a hinged flip-top polymeric closure with a tamper-evident feature.

BACKGROUND OF THE INVENTION

Polymeric closures have been used in many applications over the years in conjunction with containers. One type of polymeric closure that has been used with containers is a tamper-evident polymeric closure. Tamper-evident closures are used to prevent or inhibit tampering by providing a visible indication to a user if the closure has been opened. This visual indication typically divides the closure into two separate components after the tamper-evident feature has been broken.

Tamper-evident features have been used in polymeric closures that are flip-top closures. Some flip-top closures have an upper tamper-evident feature involving a lid and a lower tamper-evident feature on a bottom of a base. Potential drawbacks of these flip-top closures include the upper tamper-evident feature being separated from the remainder of the closure and/or having a higher likelihood of being tampered with. For example, the upper tamper-evident feature may be a "pull-away" or "break-away" feature that can be separated from the remainder of the closure and thrown away. These upper tamper-evident features are external features that have a greater likelihood of being tampered with.

If the upper tamper-evident feature is separated from the remainder of the closure and into two individual components, a portion of the flip-top closure is likely not recycled with the remainder of the closure and container. This scenario raises potential environment concerns with so many containers having tamper-evident features that can be separated into two or more individual components.

Another problem associated with flip-top closures is maintaining the opening of the closure while the user is accessing the contents of the container. This desirably needs to be performed while still having the flip-top closure not being separated into individual components.

It would be desirable to provide a flip-top closure that has tamper-evident features that address these above-noted environmental concerns, while at the same time, maintaining the opening of the closure when accessing the container contents and still performing all of the desirable properties of a closure.

SUMMARY

According to one embodiment, a flip-flop closure includes a first closure portion and a second closure portion. The first closure portion includes a polymeric top wall portion, a sealing mechanism depending from the polymeric top wall portion, and a polymeric annular skirt portion. The second closure portion includes a polymeric tamper-evident band.

The first closure portion and the second closure portion are attached by a line of weakness. The first closure portion and the second closure portion are further attached via a hinge. The hinge assists in moving the closure between the open position and the closed position. The hinge includes a polymeric locking tab, a polymeric flexible tab and a plurality of polymeric linking segments. The locking tab extends further outwardly from a center of the flip-top closure in a closed position than the flexible tab and the plurality of linking segments. During the opening of the flip-top closure, the locking tab is configured to move and pass the flexible tab such that the flip-top closure locks in a fully open position in which the locking tab is configured to contact a finish of a container.

According to one embodiment, a package includes a container and a flip-flop closure. The container has a neck portion defining an opening. The container has an outwardly-extending projection on the neck portion. The flip-top closure is configured to be secured to the neck portion of the container. The flip-top closure includes a first closure portion and a second closure portion. The first closure portion includes a polymeric top wall portion, a sealing mechanism depending from the polymeric top wall portion, and a polymeric annular skirt portion. The second closure portion includes a polymeric tamper-evident band. The first closure portion and the second closure portion are attached by a line of weakness. The first closure portion and the second closure portion are further attached via a hinge. The hinge assists in moving the closure between the open position and the closed position. The hinge includes a polymeric locking tab, a polymeric flexible tab and a plurality of polymeric linking segments. The locking tab extends further outwardly from a center of the flip-top closure in a closed position than the flexible tab and the plurality of linking segments. During the opening of the flip-top closure, the locking tab is configured to move and pass the flexible tab such that the flip-top closure locks in a fully open position in which the locking tab is configured to contact the neck portion of the container.

According to one embodiment, a flip-flop closure includes a first closure portion and a second closure portion. The first closure portion includes a polymeric top wall portion, a sealing mechanism depending from the polymeric top wall portion, and a polymeric annular skirt portion. The second closure portion includes a polymeric tamper-evident band. The first closure portion and the second closure portion are attached by a line of weakness. The first closure portion and the second closure portion are further attached via a hinge. The hinge assists in moving the closure between the open position and the closed position. The hinge includes a polymeric locking tab, a polymeric flexible tab and a plurality of polymeric linking segments. The locking tab extends further outwardly from a center of the flip-top closure in a closed position than the flexible tab and the plurality of linking segments. During the opening of the flip-top closure, the locking tab is configured to move and pass the flexible tab such that the flip-top closure locks in a fully open position in which the locking tab is configured to contact the flexible tab.

According to another embodiment, a package includes a container a flip-flop closure. The container has a neck portion defining an opening. The container has an outwardly-extending projection on the neck portion. The flip-top closure is configured to be secured to the neck portion of the container. The flip-top closure includes a first closure portion and a second closure portion. The first closure portion includes a polymeric top wall portion, a sealing mechanism depending from the polymeric top wall portion, and a polymeric annular skirt portion. The second closure portion includes a polymeric tamper-evident band. The first closure portion and the second closure portion are attached by a line of weakness. The first closure portion and the second closure portion are further attached via a hinge. The hinge assists in moving the closure between the open position and the closed position. The hinge includes a polymeric locking tab, a polymeric flexible tab and a plurality of polymeric linking segments. The locking tab extends further outwardly from a center of the flip-top closure in a closed position than the flexible tab and the plurality of linking segments. During the opening of the flip-top closure, the locking tab is configured to move and pass the flexible tab such that the flip-top closure locks in a fully open position in which the locking tab is configured to contact the flexible tab.

According to one embodiment, a flip-flop closure includes a first closure portion and a second closure portion. The first closure portion includes a polymeric top wall portion, a polymeric continuous plug seal depending from the polymeric top wall portion, a polymeric annular skirt portion, and a prying tab extending from the polymeric annular skirt portion and assisting in moving the flip-top closure between an open position and a closed position. The second closure portion includes a polymeric tamper-evident band. The first closure portion and the second closure portion are attached by a line of weakness. The first closure portion and the second closure portion are further attached via a hinge. The hinge assists in moving the closure between the open position and the closed position. The hinge includes a polymeric locking tab, a polymeric flexible tab and a plurality of polymeric linking segments. The locking tab extends further outwardly from a center of the flip-top closure in a closed position than the flexible tab and the plurality of linking segments. During the opening of the flip-top closure, the locking tab is configured to move and pass the flexible tab such that the flip-top closure locks in a fully open position in which the locking tab is configured to contact a finish of a container.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
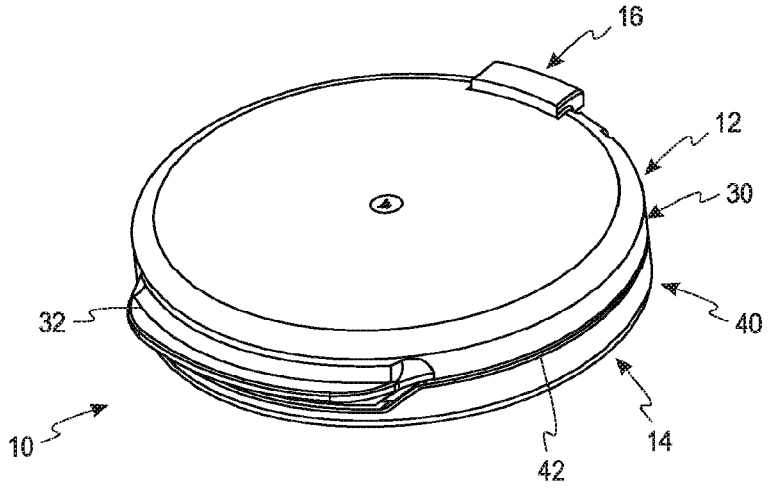
FIG. 1A is a top perspective view of a flip-top closure in a closed position according to one embodiment.
Figure 1B:
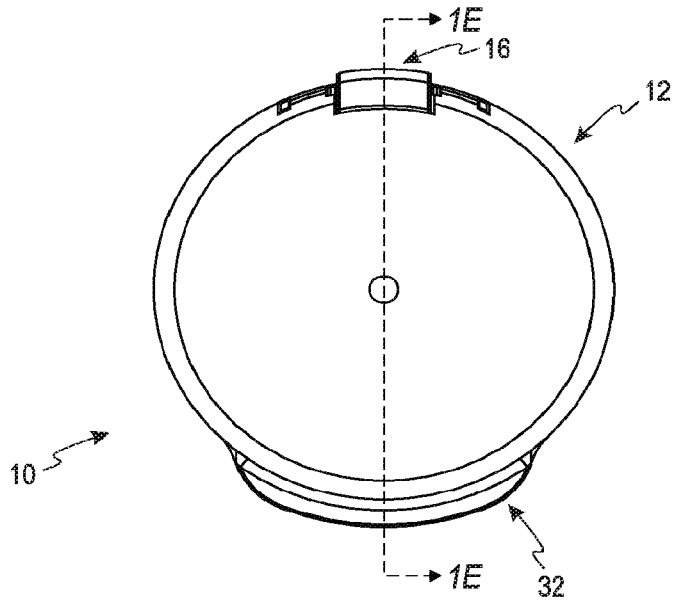
FIG. 1B is a top view of the flip-top closure of FIG. 1A.
Figure 1C:
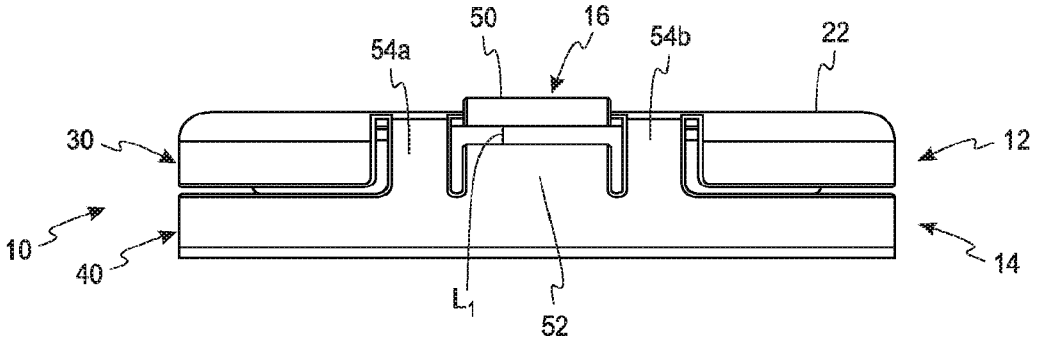
FIG. 1C is a back view of the flip-top closure of FIG. 1A.
Figure 1D:
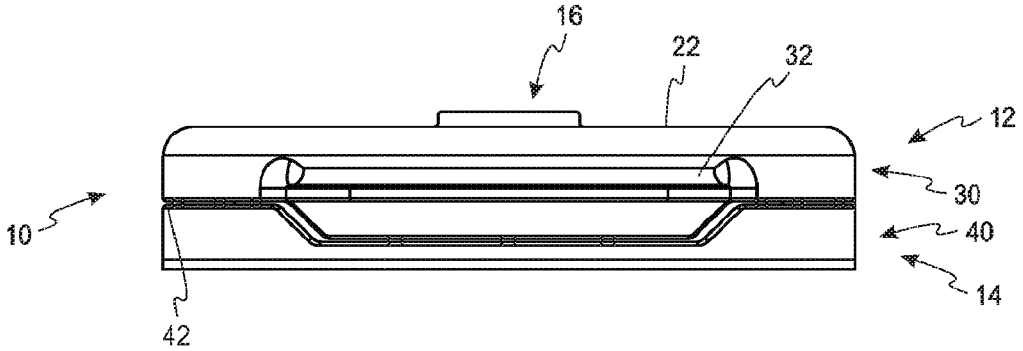
FIG. 1D is a front view of the flip-top closure of FIG. 1A.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIGS. 1A-E illustrate a polymeric flip-top closure 10 according to one embodiment of the present invention. The closures are configured to be placed on a container or bottle that contain product. The product is typically a liquid product, but also may be a solid product or a combination of a liquid and solid product. The polymeric flip-top closure 10 of FIGS. 1A-E is generally cylindrically shaped. The flip-top closure is configured to assist in keeping it with the container so as to reduce environmental waste, while still providing a desirable tamper-evident feature and maintaining the closure in an open position when accessing the contents of the container.

Referring still to FIGS. 1A-E, the polymeric flip-top closure 10 includes a first closure portion or lid 12 and a second closure portion or base 14. The flip-top closure 10 is a one-piece closure. The first closure portion 12 and the second closure portion 14 are connected via a hinge 16.

Figure 1E:
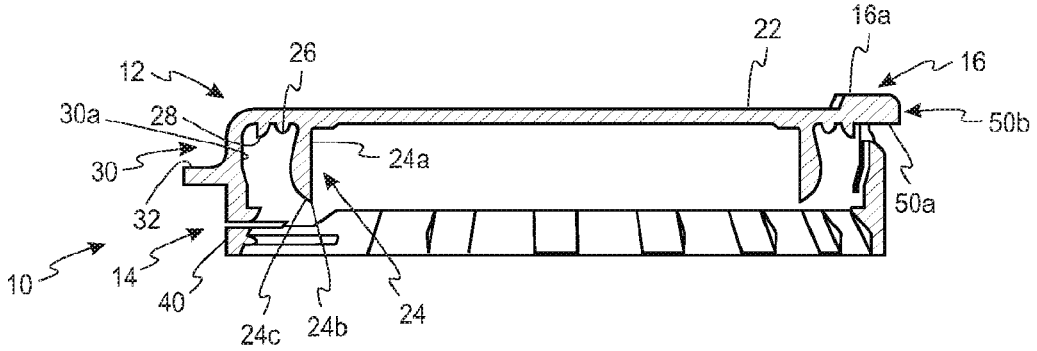
FIG. 1E is a cross-sectional view taken generally along line 1E-1E in FIG. 1B.

As shown best in FIG. 1E, the first closure portion 12 includes a polymeric top wall portion 22, a polymeric continuous plug seal 24, a polymeric top stop 26 and a polymeric outer seal 28, a polymeric annular skirt portion 30 and a prying tab 32. The second closure portion 14 includes a polymeric tamper-evident band 40.

As shown in FIG. 1E, the polymeric continuous plug seal 24 depends from the polymeric top wall portion 22 and provides an inner sealing mechanism. The continuous plug seal 24 is spaced from an interior surface 30*a* of the polymeric annular skirt portion 30 when the flip-top closure 10 is in a closed position. In one embodiment, the polymeric continuous plug seal may include interlocking bumps. The polymeric continuous plug seal 24 includes a first end 24*a* and a second end 24*b*. The second end 24*b* is located farther away from the polymeric top wall portion 22 than the first end 24*a*. The polymeric continuous plug seal 24 includes at least one interlocking bump 24*c* at a second end 24*b* to assist in snapping the first closure portion 12 into a container. The interlocking bump 24*c* desirably gives an audible sound to a user that the flip-top closure 10 has been snapped into a closed position.

The polymeric top stop 26 depends from the polymeric top wall portion 22. The polymeric top stop 26 is spaced from the interior surface 30*a* of the polymeric annular skirt portion 30 when the flip-top closure 10 is in a closed position as shown in FIG. 1E. The polymeric top seal 26 assists in providing a positive stop when the finish of the container and the closure are locked together. Thus, the top stop 26 assists in positioning the finish of the container and the closure when being placed together. The top stop 26 is typically continuous. It is contemplated that the top stop may be discontinuous in another embodiment.

The polymeric outer seal 28 depends from the polymeric top wall portion 22 and provides an outer sealing mechanism. The polymeric outer seal 28 is spaced from the interior surface 30*a* of the polymeric annular skirt portion 30 when the flip-top closure 10 is in a closed position as shown in FIG. 1E.

In another embodiment, the flip-top closure may include other sealing mechanisms. For example, the closure may include a polymeric lining material that provides a seal to the closure. In this embodiment, the closure would be formed from separate components, but would function as the one-piece closure discussed except with a different sealing mechanism. In another embodiment, the closure may include a polymeric outer seal with or without a continuous plug seal.

The second closure portion 14 includes the polymeric tamper-evident band 40. The polymeric tamper-evident band 40 depends from and is at least partially detachably connected to the polymeric annular skirt portion 30 by a frangible connection 42 as shown best in FIG. 1D. The frangible connection 42 extends substantially around the periphery of the container. The frangible connection typically extends from about 60 to about 90% around a periphery of the closure. More specifically, the frangible connection extends from about 70 to about 90% around a periphery of the closure.

Referring back to FIGS. 1A-1E, the polymeric tamper-evident band 40 of the closure 10 is located at the bottom thereof (i.e., an end opposite of the polymeric top wall portion 22). As viewed in FIGS. 1A and 1C-1E, the polymeric tamper-evident band 40 is a lower tamper-evident feature. The tamper-evident band 40 works in conjunction with the container to indicate to a user that the contents of the container may have been accessed. More specifically, the tamper-evident band 40 is designed to partially separate from the annular skirt portion 30 if a user opens the package by flipping the flip-top closure via the hinge 16.

Figure 3A:
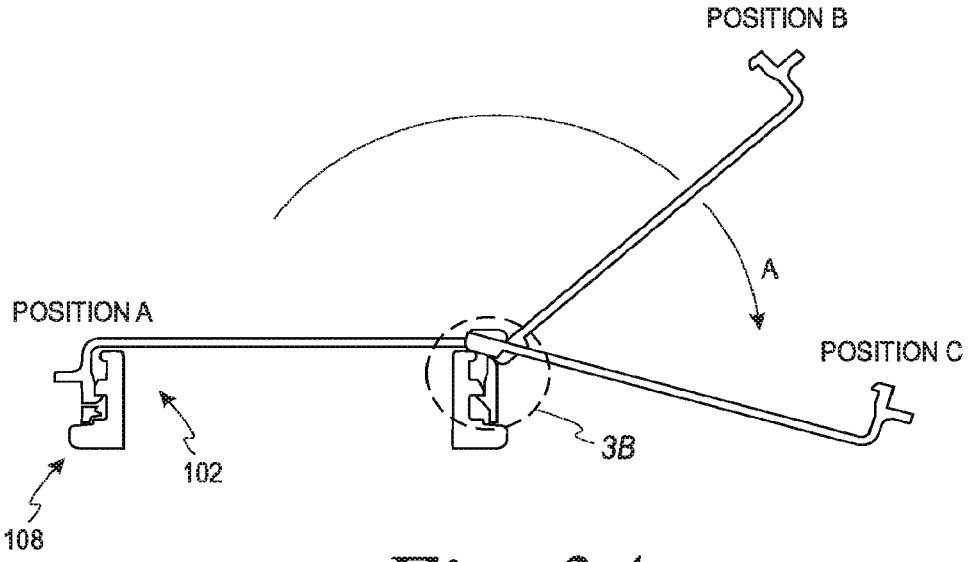
FIG. 3A is a cross-sectional schematic view (without interior features of the closure for clarity) taken generally along line 2B-2B in FIG. 2A in three different positions (Positions A-C).
Figure 3B:
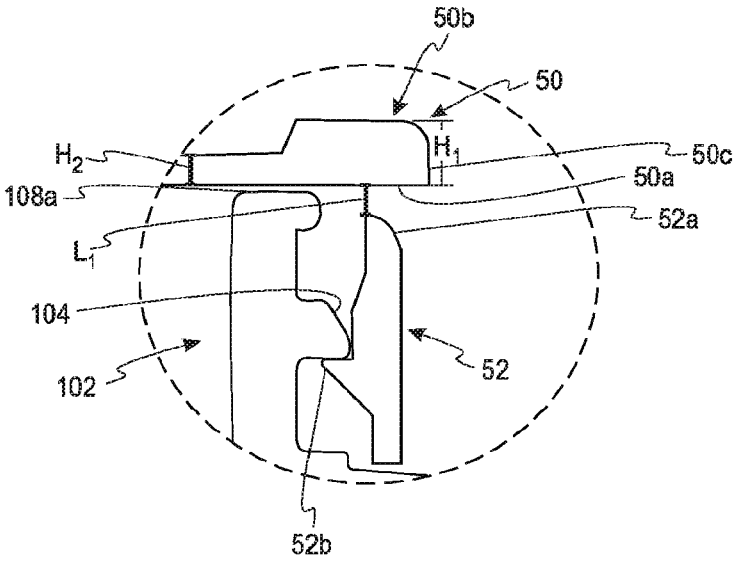
FIG. 3B is an enlarged view of area 3B in FIG. 3A depicting the interaction of the locking tab, flexible tab and container finish in Position A.

The first closure portion 12 and the second closure portion 14 are attached by the hinge 16. The hinge 16 assists in moving the flip-top closure 10 between an open position and a closed position. The hinge 16 is shown in FIGS. 1A-1E in the closed position. As will be discussed and shown below in FIGS. 3A-3D and 4A-4C, the hinge 16 is adapted to flip from a closed position to an open position generally along arrow A of FIG. 3A and from an open position to a closed position generally along arrow B of FIG. 4A. The hinge 16 is located further outwardly than a remainder of the closure 10 as shown in FIGS. 1E and 3B. The hinge 16 is also raised relative to the remainder of the closure 10. This is shown in FIG. 1E where an upper surface 16*a* is at a higher point than the remainder of the closure 10.

It is most desirable for the hinge 16 to flip or rotate at least about 200 or about 215 degrees or even more desirably at least about 225 or about 235 degrees from a closed position to an open position. The hinge 16 may flip or rotate up to about 215 or about 225 degrees. It is desirable for the hinge 16 to flip or rotate up to about 235 degrees. The hinge typically flips or rotates from about 190 to about 235 degrees and, more specifically, from about 190 to about 225 degrees.

Referring back to FIG. 1C, the hinge 16 includes a locking tab 50, a flexible tab 52 and a plurality of linking segments 54*a*, 54*b*. The locking tab 50 includes a lower surface 50*a* (FIG. 1E) that will be discussed in detail below. The locking tab 50 extends further outwardly from a center of the flip-top closure 10 in a closed position than the flexible tab 52 and the plurality of linking segments 54*a*, 54*b* as shown best in FIGS. 1E and 3B. To provide additional strength and support to the lower surface 50*a* of the locking tab 50, the locking tab 50 also includes a raised or thicker portion 50*b* than a remainder of the hinge 16. This is shown best in FIG. 3B where height H1 of the raised or thicker portion 50*b* is greater than height H2 of the remainder of the hinge 16. The raised portion 50*b* also assists when making contacting with the flexible tab 52 during the process of opening or closing the flip-top closure 10. This raised portion 50*b* assists in preventing or inhibiting the tamper-evident band 40 from being inadvertently pulled off from the remainder of the closure 10 when being closed.

The frangible connection 42 may be formed by molded-in-bridges in one embodiment. The molded-in-bridges are typically formed using a feature in the mold. In another embodiment, the frangible connection may be formed using scoring or scored lines, notches, leaders, nicks or other lines of weaknesses. The line of weakness may be formed by continuous slitting.

Figure 2A:
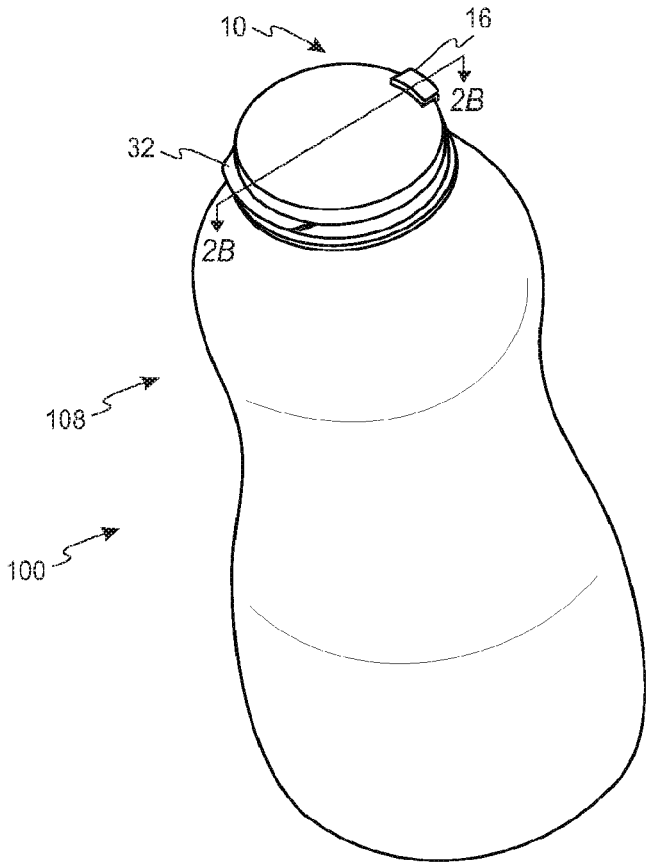
FIG. 2A is a top perspective view of a package including the flip-top closure of FIG. 1A and a container in a closed position according to one embodiment.
Figure 2B:
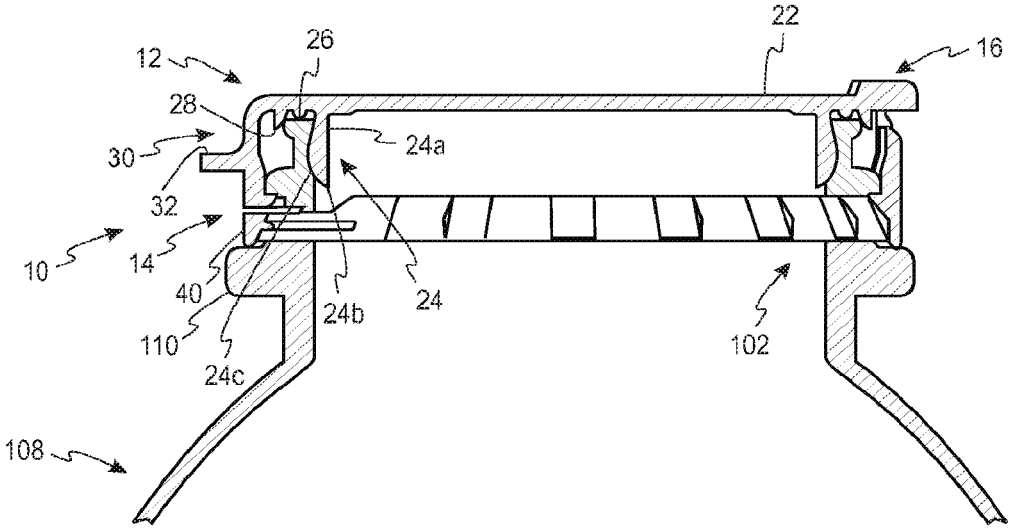
FIG. 2B is a cross-sectional view taken generally along line 2B-2B in FIG. 2A.

One non-limiting example of a flip-top closure and a container forming a package is shown and discussed in conjunction with FIGS. 2A, 2B.

The closure 10 may be used with a container 108 used to form a package 100 of FIGS. 2A, 2B. The container 108 includes a neck portion 102 that defines an opening. The neck portion 102 of the container 108 includes a continuous outer ring 110. The continuous outer ring 110 assists in positioning the tamper-evident band 40 on the neck portion 102 of the container 108 when the frangible connection 42 is broken. As will be discussed in detail below, the closure 10 is placed onto and locked with the neck portion 102 of the container 108.

The flip-top closures of the present invention may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the flip-top closures may include an oxygen-barrier material. The oxygen-barrier material may be added as a separate layer or may be integrated within the closure itself. The oxygen-barrier materials assist in preventing or inhibiting oxygen from entering the container through the closure. These materials may include, but are not limited to, ethylene vinyl alcohol (EVOH). It is contemplated that other oxygen-barrier materials may be used in the closure.

Additionally, it is contemplated that other features may be included in the closure described above. For example, U.S. Publication No. 2018/009979, U.S. Publication No. 2017/0349336, U.S. Pat. Nos. 9,126,726, 9,085,385, 8,763,830, 8,485,374, U.S. Publication No. 2009/0045158 and U.S. Pat. No. 6,123,212 all include features that could be incorporated in the closures of the present invention. All of these references are hereby incorporated by reference in their entireties.

The top wall portion 22, the continuous plug seal 24, the top stop 26, the outer seal 28 and the annular skirt portion 30 are made of polymeric material. The top wall portion 22, the continuous plug seal 24, top stop 26, the outer seal 28 and the annular skirt portion 30 are typically made of an olefin (e.g., polyethylene (PE), polypropylene (PP)), polyethylene terephthalate (PET) or blends thereof. One example of a polyethylene that may be used in high density polyethylene (HDPE). It is contemplated that the top wall portion, the continuous plug seal, the top stop, the outer seal, and the annular skirt portion may be made of other polymeric materials. The tamper-evident band 40 is typically made of the same materials as the top wall portion 22, continuous plug seal 24, the top stop 36, the outer seal 28 and the annular skirt portion 30.

It is contemplated the polymeric materials may include additional ingredients such nucleating agents, lubricants, bio-based fillers (e.g., sawdust, starch) and mineral-based fillers (e.g., calcium carbonate, talc). The polymeric material may be made from post-consumer recycled resin.

The closures are typically formed by processes such as injection or compression molding, extrusion or the combination thereof.

The container 108 is also typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. It is also contemplated that the container may be formed of glass or other materials. The container 108 typically has an encapsulated oxygen-barrier layer or oxygen barrier material incorporated therein.

In one method to open the container 108 and gain access to the product therein, the first closure portion 12 is initially rotated or flipped with respect to the second closure portion 14, which results in breaking and separating via the frangible connection 42. The rotating or flipping is shown in FIG. 3A where Position A is the closed position and Position C is the fully open position. Position B is an intermediate position between the closed and open positions.

The flip-top closure 10 is moved along arrow A to flip or rotate at least about 200 or about 215 degrees or even more desirably at least about 225 or about 235 degrees from a closed position to an open position. The hinge 16 may flip or rotate up to about 215 or about 225 degrees. It is desirable for the hinge 16 to flip or rotate up to about 235 degrees. The hinge typically flips or rotates from about 190 to about 235 degrees and, more specifically, from about 190 to about 225 degrees Referring to FIG. 3B, the relationship of the locking tab 50 and the flexible tab 52 is shown in the closed position (Position A). The lower surface 50*a* of the locking tab 50 is spaced above a top surface 108*a* of the container 108 as shown in FIG. 3B. In this position (Position A), the locking tab 50 is spaced from the flexible tab 52. This length L1 between the locking tab 50 and the flexible tab 52 is generally from about 0.02 to about 0.2 inch and, more specifically, from about 0.2 to about 0.1 inch.

The flexible tab 52 includes an inwardly-extending projection 52*b* configured to contact an outwardly-extending projection 104 of the container 108 so as to secure and lock the flip-top closure 10 and the container 108. The inwardly-extending and outwardly-extending projections may be continuous or intermittent. It is contemplated that the closure and container may be secured and locked by other known methods in the art. For example, the closure and container may be secured and locked by continuous folded bands, tabs or wings.

Figure 3C:
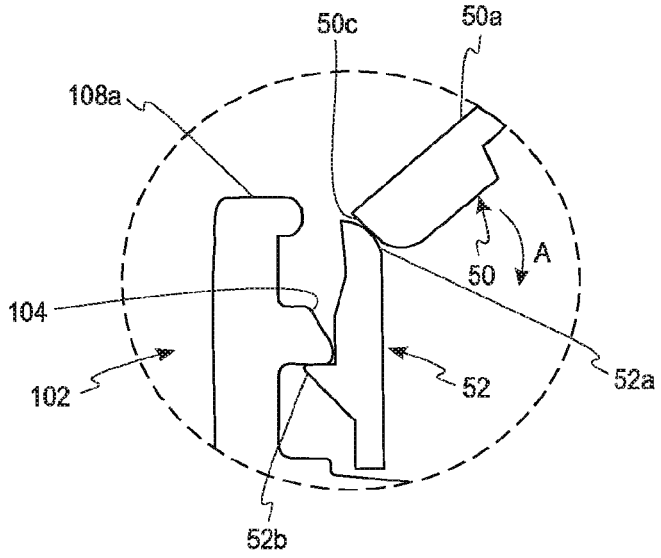
FIG. 3C is an enlarged view of area 3B in FIG. 3A depicting the interaction of the locking tab, flexible tab and container finish in Position B.

As the flip-top closure 10 is moved from Position A to Position B (FIG. 3C), the locking tab 50 contacts the flexible tab 52. As the locking tab 50 continues to rotate, a side surface 50*c* of the locking tab 50 contacts an upper surface 52*a* of the flexible tab 52. This is shown in FIG. 3C in Position B. As the locking tab 50 continues to rotate from Position B to Position C, the locking tab 50 rotates or pivots on the flexible tab 52 until the locking tab 50 clears the flexible tab 52. The locking tab 50 as shown in FIG. 3D contacts the top surface 108*a* of the container 108.

Figure 3D:
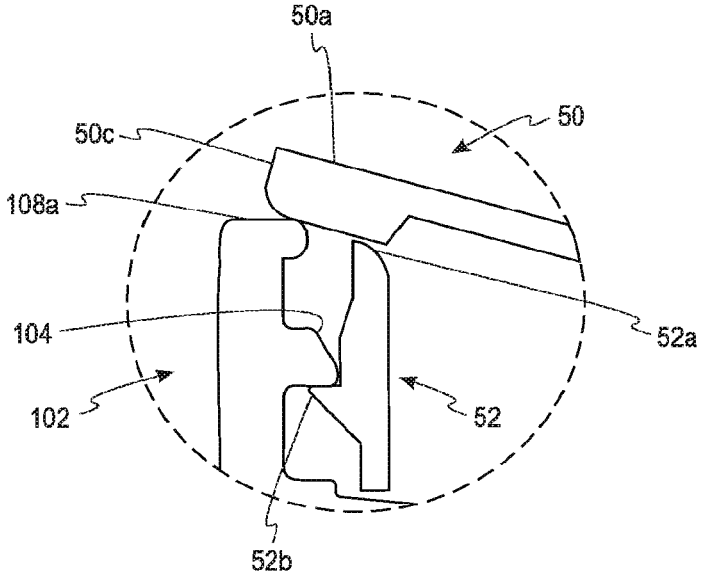
FIG. 3D is an enlarged view of area 3B in FIG. 3A depicting the interaction of the locking tab, flexible tab and container finish in Position C.

FIG. 3D depicts the locking tab 50 being slightly spaced from the flexible tab 52. The locking tab 50 locks and snaps into place and stays in the open or flipped position when a user is accessing the container contents.

Figure 4A:
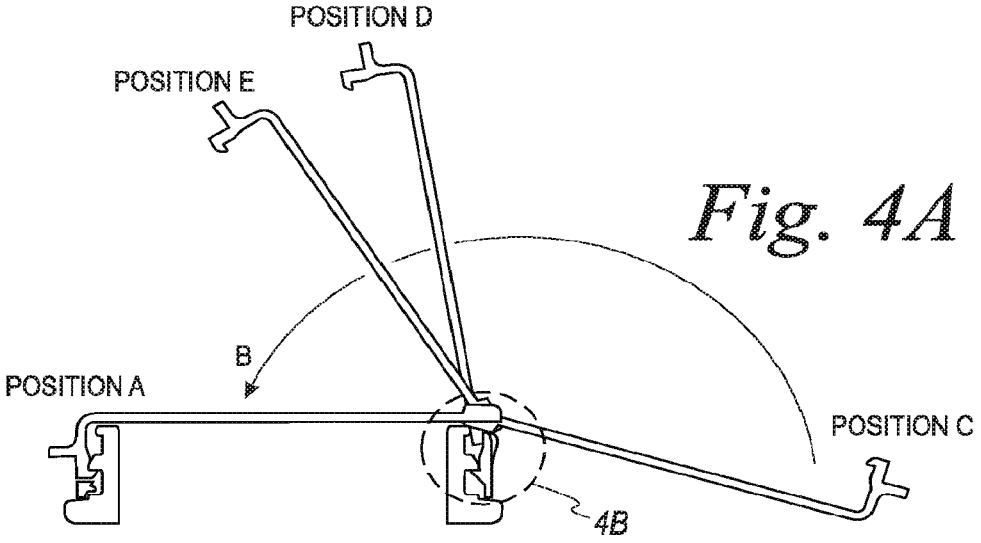
FIG. 4A is a cross-sectional schematic view (without interior features of the closure for clarity) taken generally along line 2B-2B in FIG. 2A in four different positions (Positions C-E and A).
Figure 4B:
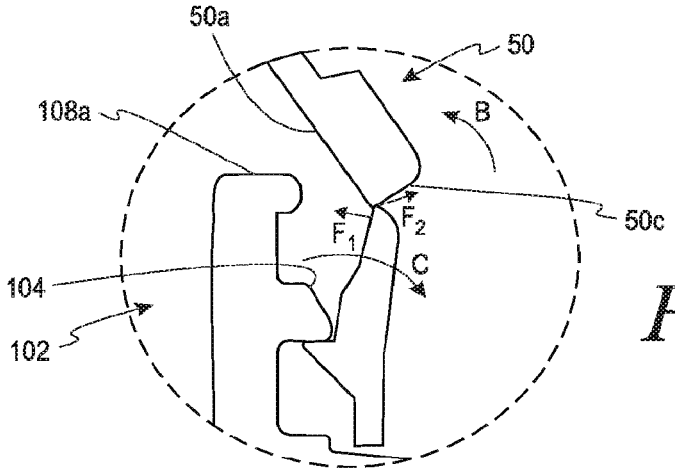
FIG. 4B is an enlarged view of area 4B in FIG. 4A depicting the interaction of the locking tab, flexible tab and container finish in Position D.
Figure 4C:
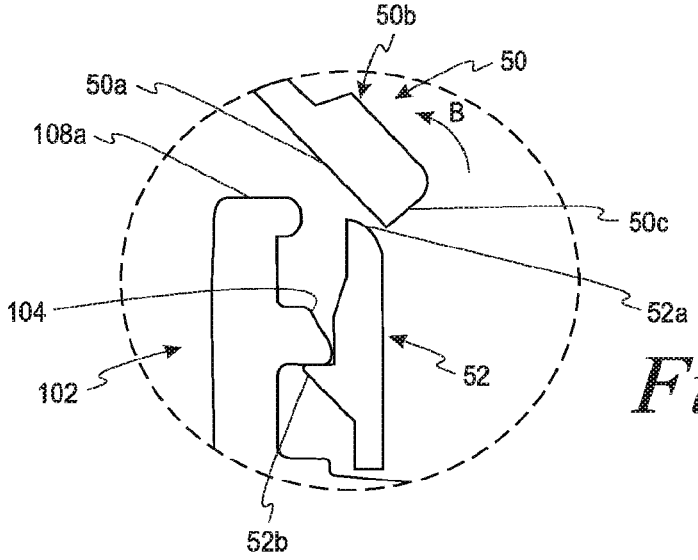
FIG. 4C is an enlarged view of area 4B in FIG. 4A depicting the interaction of the locking tab, flexible tab and container finish in Position E.

FIGS. 4A-4C depict positions from the fully open position (Position C) through Positions D and E before returning to the closed position (Position A) via arrow B. FIG. 4B (Position D) depicts the locking tab 50 just before clearing the flexible tab 52. As shown in FIG. 4B, the flexible tab 52 is shown as being flexed outwardly from the container 108 during the movement of the locking tab 50. This outward deflection of the flexible tab 52 is shown by the movement of the arrow C. This outward deflection of the flexible tab 52 is forced when the locking tab 50 makes contact. Specifically, there is a force F2 from the locking tab that is greater than the force F1 from the flexible tab 52, resulting in the flexible tab 52 being deflected outwardly (i.e., in the direction away from the container 108).

As the flip-top closure 10 moves from Position D to Position E, the locking tab 50 clears the flexible tab 52 in which the flexible tab 52 returns back to its original or un-flexed position as shown in FIG. 4C. During the movement from the Position D to Position E, when the locking tab 50 contacts the flexible tab and moves it outwardly, the return of the flexible tab 52 to its original or un-flexed position (FIG. 4C) results in an audible sound or click in one method.

Figure 5A:
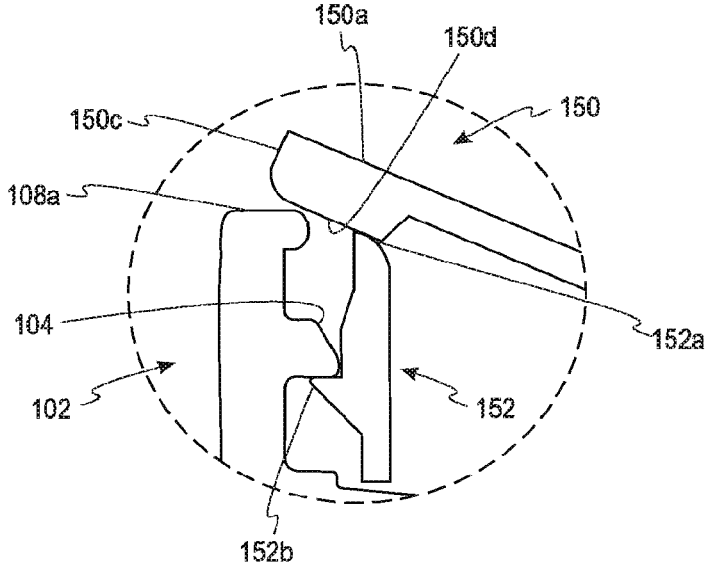
FIG. 5A is an enlarged view depicting the interaction of the locking tab, flexible tab and container finish in an open position according to another embodiment.

It is contemplated that a lower surface of the locking tab may contact the flexible tab in a closed position according to another embodiment. For example, the neck portion 102 of the container is shown in FIG. 5A in which a locking tab 150 has a lower surface 150*a*, a side surface 150*b* and an upper surface 150*d* in which the upper surface 150*d* contacts an upper surface 152*a* of a flexible tab 152. The locking tab 150 and the flexible tab 152 function in a similar manner in this embodiment as the locking tab 50 and the flexible tab 52 discussed above except in relationship to the open position.

Figure 5B:
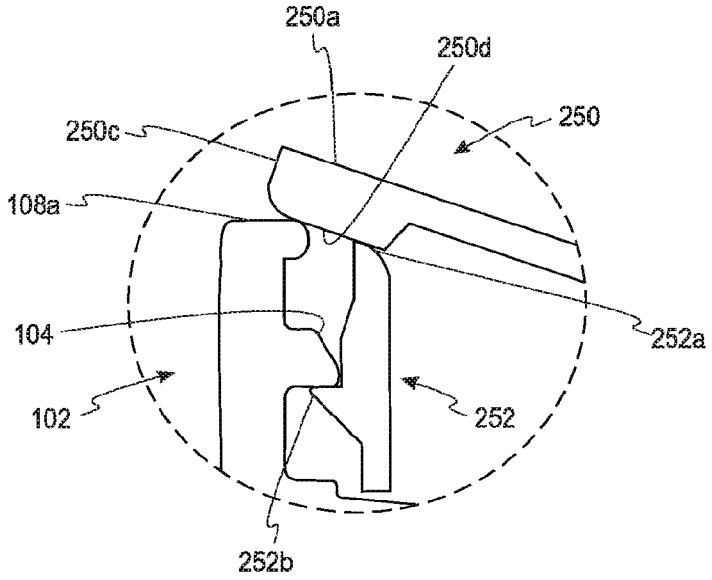
FIG. 5B is an enlarged view depicting the interaction of the locking tab, flexible tab and container finish in an open position according to a further embodiment.

In another embodiment, FIG. 5B depicts a locking tab 250 having a lower surface 250*a*, a side surface 250*b* and an upper surface 250*d* in which the upper surface 250*d* contacts both an upper surface 252*a* of a flexible tab 252 and the top surface 108*a* of the container 108. The locking tab 250 and the flexible tab 252 function in a similar manner in this embodiment as the locking tab 50 and the flexible tab 52 except in relationship to the open position.

The polymeric closures of the present invention are especially desirable for larger closures. For example, the present invention can be used with closures having a 26 mm, 28 mm, and 38 mm diameters. Thus, the present invention is desirable using closures having between about 25 mm and about 50 mm diameters and, more specifically, from about 25 m to about 40 mm diameter.

The polymeric closures of the present invention are desirable in both low-temperature and high-temperature applications. The polymeric closures may be used in low-temperature applications such as an ambient or a cold fill. These applications include water, sports drinks, aseptic applications such as dairy products, and pressurized products such as carbonated soft drinks. It is contemplated that other low-temperature applications may be used with the polymeric closures formed by the processes of the present invention.

The polymeric closures of the present invention may be exposed to high-temperature applications such as hot-fill, pasteurization, and retort applications. A hot fill application is generally performed at temperatures around 185° F., while a hot-fill with pasteurization is generally performed at temperatures around 205° F. Retort applications are typically done at temperatures greater than 250° F. It is contemplated that the polymeric closures of the present invention can be used in other high-temperature applications.

What is claimed is:

1. A flip-top closure comprising:

a first closure portion including:

a polymeric top wall portion, a sealing mechanism depending from the polymeric top wall portion, and a polymeric annular skirt portion; and a second closure portion including:

a polymeric tamper-evident band, wherein the first closure portion and the second closure portion are attached by a line of weakness, wherein the first closure portion and the second closure portion are further attached via a hinge, the hinge assisting in moving the flip-top closure between the open position and the closed position, the hinge including a polymeric locking tab, a polymeric flexible tab and a plurality of polymeric linking segments, the polymeric locking tab extending further outwardly from a center of the flip-top closure in a closed position than the polymeric flexible tab and the plurality of polymeric linking segments, wherein during the opening of the flip-top closure, the polymeric locking tab is configured to move and pass a convex surface of the polymeric flexible tab such that the flip-top closure locks in a fully open position in which the polymeric locking tab is configured to contact a finish of a container, wherein a surface of the polymeric locking tab contacts a top edge of the polymeric flexible tab when moving to a fully open position, the contacting surface of the polymeric locking tab causing an outward deflection of the polymeric flexible tab.

2. The flip-top closure of claim 1, wherein the sealing mechanism is a polymeric continuous plug seal including a first end and a second end, the second end being located farther away from the polymeric top wall portion than the first end, the polymeric continuous plug seal including at least one interlocking bump at a second end to assist in snapping the flip-top closure into a closed position.

3. The flip-top closure of claim 1, wherein the shape of the flip-top closure is generally cylindrical and is a one-piece closure.

4. The flip-top closure of claim 1, wherein the plurality of polymeric linking segments is two linking segments, in which the polymeric locking tab and the polymeric flexible tab are located between the two linking segments.

5. The flip-top closure of claim 1, wherein the polymeric flexible tab includes an inwardly-extending projection configured to contact an outwardly-extending projection of a container so as to secure the flip-top closure and the container.

6. The flip-top closure of claim 1, wherein the first closure portion further includes a polymeric top stop depending from the polymeric top wall portion to assist in positioning the flip-top closure to the finish of a container.

7. The flip-top closure of claim 1, wherein the first closure portion further includes a polymeric outer seal to assist in providing an outer seal with the finish of a container.

8. The flip-top closure of claim 1, wherein the closure comprises polyolefins.

9. The flip-top closure of claim 1, wherein the hinge is adapted to flip at least 200 degrees.

10. The flip-top closure of claim 9, wherein the hinge is adapted to flip at least 225 degrees.

11. The flip-top closure of claim 1, wherein the hinge is adapted to flip up to 235 degrees.

12. The flip-top closure of claim 1, wherein the hinge is adapted to flip between 200 and 225 degrees.

13. The flip-top closure of claim 1, wherein the sealing mechanism is a polymeric continuous plug seal.

14. The flip-top closure of claim 1, wherein the first closure portion further includes a prying tab extending from the polymeric annular skirt portion and assisting in moving the flip-top closure between an open position and a closed position.

15. The flip-top closure of claim 1, wherein the polymeric locking tab has a raised portion relative to the remainder of the hinge.

16. The flip-top closure of claim 1, wherein a surface of an inwardly-extending projection of the polymeric flexible tab is configured to contact a bottom surface of an outwardly-extending projection of a container, the bottom surface of the outwardly-extending projection of the container being located farther from a top surface of the container than a remainder of the outwardly-extending projection.

17. A package comprising:

a container having a neck portion defining an opening, the container having an outwardly-extending projection on the neck portion; and a flip-top closure being configured to be secured to the neck portion of the container, the flip-top closure including a first closure portion and a second closure portion, the first closure portion including a polymeric top wall portion, a sealing mechanism depending from the polymeric top wall portion, a polymeric annular skirt portion, the second closure portion including a polymeric tamper-evident band, wherein the first closure portion and the second closure portion are attached by a line of weakness, wherein the first closure portion and the second closure portion are further attached via a hinge, the hinge assisting in moving the flip-top closure between the open position and the closed position, the hinge including a polymeric locking tab, a polymeric flexible tab and a plurality of polymeric linking segments, the polymeric locking tab extending further outwardly from a center of the flip-top closure in a closed position than the polymeric flexible tab and the plurality of polymeric linking segments, wherein during the opening of the flip-top closure, the polymeric locking tab is configured to move and pass a convex surface of the polymeric flexible tab such that the flip-top closure locks in a fully open position in which the polymeric locking tab is configured to contact the neck portion of the container, wherein a surface of the polymeric locking tab contacts a top edge of the polymeric flexible tab when moving to a fully open position, the contacting surface of the polymeric locking tab causing an outward deflection of the polymeric flexible tab.

18. The package of claim 17, wherein the polymeric flexible tab includes an inwardly-extending projection configured to contact an outwardly-extending projection of the container so as to secure the flip-top closure and the container.

19. The package of claim 17, wherein the first closure portion further includes a polymeric top stop depending from the polymeric top wall portion to assist in positioning the flip-top closure to the finish of the container and a polymeric outer seal to assist in providing an outer seal with the finish of the container.

20. The package of claim 17, wherein the hinge is adapted to flip at least 200 degrees.

21. The package of claim 20, wherein the hinge is adapted to flip at least 225 degrees.

22. The package of claim 17, wherein the hinge is adapted to flip up to 235 degrees.

23. The package of claim 17, wherein a surface of an inwardly-extending projection of the polymeric flexible tab is configured to contact a bottom surface of an outwardly-extending projection of a container, the bottom surface of the outwardly-extending projection of the container being located farther from a top surface of the container than a remainder of the outwardly-extending projection.

24. A flip-top closure comprising:

a first closure portion including:

a polymeric top wall portion, a sealing mechanism depending from the polymeric top wall portion, a polymeric annular skirt portion; and a second closure portion including:

a polymeric tamper-evident band, wherein the first closure portion and the second closure portion are attached by a line of weakness, wherein the first closure portion and the second closure portion are further attached via a hinge, the hinge assisting in moving the first closure between the open position and the closed position, the hinge including a polymeric locking tab, a polymeric flexible tab and a plurality of polymeric linking segments, the polymeric locking tab extending further outwardly from a center of the flip-top closure in a closed position than the polymeric flexible tab and the plurality of polymeric linking segments, wherein during the opening of the flip-top closure, the polymeric locking tab is configured to move and pass a convex surface of the polymeric flexible tab such that the flip-top closure locks in a fully open position in which the polymeric locking tab is configured to contact the polymeric flexible tab, wherein a surface of the polymeric locking tab contacts a top edge of the polymeric flexible tab when moving to a fully open position, the contacting surface of the polymeric locking tab causing an outward deflection of the polymeric flexible tab.

25. The flip-top closure of claim 24, wherein the first closure portion further includes a polymeric top stop depending from the polymeric top wall portion to assist in positioning the flip-top closure to the finish of a container and a polymeric outer seal to assist in providing an outer seal with the finish of a container.

26. The flip-top closure of claim 24, wherein the hinge is adapted to flip at least 200 degrees.

27. The flip-top closure of claim 26, wherein the hinge is adapted to flip at least 225 degrees.

28. The flip-top closure of claim 24, wherein the hinge is adapted to flip up to 235 degrees.

29. The flip-top closure of claim 24, wherein the sealing mechanism is a polymeric continuous plug seal.

30. The flip-top closure of claim 24, wherein the polymeric locking tab has a raised portion relative to the remainder of the hinge.

31. The flip-top closure of claim 24, wherein a surface of an inwardly-extending projection of the polymeric flexible tab is configured to contact a bottom surface of an outwardly-extending projection of a container, the bottom surface of the outwardly-extending projection of the container being located farther from a top surface of the container than a remainder of the outwardly-extending projection.

32. A package comprising:

a container having a neck portion defining an opening, the container having an outwardly-extending projection on the neck portion; and a flip-top closure being configured to be secured to the neck portion of the container, the flip-top closure including a first closure portion and a second closure portion, the first closure portion including a polymeric top wall portion, a sealing mechanism depending from the polymeric top wall portion, a polymeric annular skirt portion, the second closure portion including a polymeric tamper-evident band, wherein the first closure portion and the second closure portion are attached by a line of weakness, wherein the first closure portion and the second closure portion are further attached via a hinge, the hinge assisting in moving the flip-top closure between the open position and the closed position, the hinge including a polymeric locking tab, a polymeric flexible tab and a plurality of polymeric linking segments, the polymeric locking tab extending further outwardly from a center of the flip-top closure in a closed position than the polymeric flexible tab and the plurality of polymeric linking segments, wherein during the opening of the flip-top closure, the polymeric locking tab is configured to move and pass a convex surface of the polymeric flexible tab such that the flip-top closure locks in a fully open position in which the polymeric locking tab is configured to contact the polymeric flexible tab, wherein a surface of the polymeric locking tab contacts a top edge of the polymeric flexible tab when moving to a fully open position, the contacting surface of the polymeric locking tab causing an outward deflection of the polymeric flexible tab.

33. The package of claim 32, wherein the polymeric flexible tab includes an inwardly-extending projection configured to contact an outwardly-extending projection of the container so as to secure the flip-top closure and the container.

34. The package of claim 32, wherein a surface of an inwardly-extending projection of the polymeric flexible tab is configured to contact a bottom surface of an outwardly-extending projection of a container, the bottom surface of the outwardly-extending projection of the container being located farther from a top surface of the container than a remainder of the outwardly-extending projection.

35. A flip-top closure comprising:

a first closure portion including:

a polymeric top wall portion, a polymeric continuous plug seal depending from the polymeric top wall portion, a polymeric annular skirt portion, and a prying tab extending from the polymeric annular skirt portion and assisting in moving the flip-top closure between an open position and a closed position; and a second closure portion including:

a polymeric tamper-evident band, wherein the first closure portion and the second closure portion are attached by a line of weakness, wherein the first closure portion and the second closure portion are further attached via a hinge, the hinge assisting in moving the flip-top closure between the open position and the closed position, the hinge including a polymeric locking tab, a polymeric flexible tab and a plurality of polymeric linking segments, the polymeric locking tab extending further outwardly from a center of the flip-top closure in a closed position than the polymeric flexible tab and the plurality of polymeric linking segments, wherein during the opening of the flip-top closure, the polymeric locking tab is configured to move and pass a convex surface of the polymeric flexible tab such that the polymeric flip-top closure locks in a fully open position in which the polymeric locking tab is configured to contact a finish of a container, wherein a surface of the polymeric locking tab contacts a top edge of the polymeric flexible tab when moving to a fully open position, the contacting surface of the polymeric locking tab causing an outward deflection of the polymeric flexible tab.

36. The flip-top closure of claim 35, wherein a surface of an inwardly-extending projection of the polymeric flexible tab is configured to contact a bottom surface of an outwardly-extending projection of a container, the bottom surface of the outwardly-extending projection of the container being located farther from a top surface of the container than a remainder of the outwardly-extending projection.

* * * * *